US008757751B2

(12) United States Patent
Hu et al.

(10) Patent No.: US 8,757,751 B2
(45) Date of Patent: Jun. 24, 2014

(54) SWITCHING DRIVING METHOD USED FOR A DRIVING SYSTEM

(71) Applicant: National Chiao Tung University, Hsinchu (TW)

(72) Inventors: Jwu-Sheng Hu, Hsinchu (TW); Hsien-Tang Jao, Hsinchu County (TW)

(73) Assignee: National Chiao Tung University, Hsinchu (TW)

( * ) Notice: Subject to any disclaimer, the term of this patent is extended or adjusted under 35 U.S.C. 154(b) by 84 days.

(21) Appl. No.: 13/713,347

(22) Filed: Dec. 13, 2012

(65) Prior Publication Data

US 2014/0125721 A1 May 8, 2014

(30) Foreign Application Priority Data

Nov. 2, 2012 (TW) ..... 101140654 A

(51) Int. Cl.
*B41J 29/38* (2006.01)

(52) U.S. Cl.
USPC ..... 347/10; 347/9

(58) Field of Classification Search
CPC ... B41J 2/04588; B41J 2/04541; B41J 2/0455
USPC ..... 347/9, 10
See application file for complete search history.

(56) References Cited

U.S. PATENT DOCUMENTS 7,866,798 B2 * 1/2011 Sakurai et al. ..... 347/12
8,191,996 B2 * 6/2012 Omata et al. ..... 347/57

* cited by examiner

*Primary Examiner* — Jannelle M Lebron
(74) *Attorney, Agent, or Firm* — Bacon & Thomas, PLLC

(57) ABSTRACT

The present invention discloses a switching driving method used for a driving system. The driving system transforms any type of waveforms to switching signal array by switching strategy modulation, and transmits to switching circuit. Any type of driving waveforms can be generated through high-speed switching the switching circuit. The waveforms can be generated by operating the switching circuit with the switching strategy. The losses of the switch can be reduced, and the modulation ability of driving signal having several waveforms and multi-channels can be improved.

20 Claims, 5 Drawing Sheets

SWITCHING DRIVING METHOD USED FOR A DRIVING SYSTEM

BACKGROUND OF THE INVENTION

1. Field of the Invention

The present invention relates to a switching driving method used for a driving system, and particularly to a switching driving method for generating any type of driving waveforms through high-speed switching the switching circuit.

2. Description of the Prior Art

With the development of semiconductor technology and materials science, the industrial printing technology has become one of important research and development points of advanced process technology gradually, such as the three-dimensional solid ink printer, printed circuit board design inkjet printer, thin film transistor inkjet printer, solar cell electrode making, and biomedical chip enzyme printing process etc.

As described by the design principle, the digital/analog converter and a matched amplifier are usually adopted for the design and realization way of inkjet print head driving signal generator. However, better linear result can be achieved by this kind of way through the amplifier or driving the integrated circuit, but high temperature and waste heat are apt to be produced by operating under high-frequency environment for a long time. Upon using in variable applications, perhaps one or several driving signals are required to achieve the function for several sets of loading at the same time. Not only the additional heat dissipation system or the temperature reducing device is required, but also the volume is large and unit price is high. These factors are the difficulty and challenge encountered for realizing the multi-channel load driving circuit.

Referring to U.S. Pat. No. 7,891,752, it discloses an inkjet device and its correlation method. This technology uses the digital/analog converter to detect the voltage through the driving signal generated by the driving unit, and conduct the voltage feedback modulation control of ink drop size through the image recognition unit. In addition, referring to U.S. Pat. No. 6,499,820, it discloses a device to store the waveforms in a register, and switches the selected waveforms through the waveforms selection unit. These waveforms are transformed to the driving waveforms through the digital/analog converter and signal amplifier, in order to drive the inkjet print head.

In order to get better linearity of driving signal, the conventional industrial inkjet print head often uses small signal with high-voltage amplifier or directly uses the driving integrated circuit as the signal generation unit. Although there is better linearity for this kind of driving design, it is unable to offer the independent driving signal to each channel independently.

Therefore, how to improve the precision and homogeneity of inkjet process has become an important issue of industrial printing technology.

SUMMARY OF THE INVENTION

In as much as the above-mentioned drawbacks of the previous art, the present invention provides a switching driving method used for a driving system. The driving system compensates the variance among the nozzles of inkjet print head by a waveforms modulation way with high resolution and degree of freedom, in order to improve the precision and homogeneity of inkjet process.

The present invention adopts a switching circuit with the switching strategy to change the driving way of the switching circuit, in order to generate any type of driving waveforms to reduce the losses of switch.

The present invention provides a switching driving method used for a driving system. The driving system comprises a control unit, a switching strategy demodulation unit, a memory unit, a shifting unit and a counting unit. Wherein, the control unit is connected to the memory unit. The switching strategy demodulation unit is connected between the control unit and the memory unit. The memory unit is connected to the shifting unit. The shifting unit is connected to the control unit and the memory unit. The steps of switching driving method include: (a) The control unit receives a driving signal with the driving waveforms, and cuts the driving signal into n sections; (b) The control unit resolves a driving voltage of the driving signal into $2^n$ switches, in order to switch $2^n$ times within a pre-described time period; (c) The switching strategy demodulation unit transforms the driving waveforms into the switching signal in accordance with the driving voltage of the driving signal, and the switching signals form a switching signal array; (d) Store the switching signal in the memory unit; (e) The shifting unit duplicates the switching signal of the memory unit, begins to broadcast the switching signal to a driving unit; (f) When the shift times of shifting unit is accumulated to $2^n$ times, the counting unit transmits a termination command to the control unit; and (g) After receiving the termination command, the control unit carries on the adjustment in accordance with the demand.

In the switching driving method of the present invention, when the shift times of shifting unit is reached $2^n$ times, a time of inkjet print head driving waveforms is generated by the driving system.

In the switching driving method of the present invention, the control unit divides a driving waveform into a plurality of sections, and transmits a state broadcast command to the shifting unit, and the control unit receives a termination command and a switching state upgrade signal from the counting unit. The memory unit remembers the switching state upgrade signal transmitted by the control unit, and upgrades the switching signal in accordance with the counting unit.

In the switching driving method of the present invention, the shifting unit receives the content of memory unit, and conducts the shifting motion of length in accordance with the length of memory unit. The counting unit checks the shifting times of shifting unit in accordance with the length of memory unit. When the shifting unit makes a specific number of shifting times, the counting unit transmits the switching state upgrade signal to the control unit.

In the switching driving method of the present invention, the control unit includes one of the fuzzy, proportional, derivative, integral, back-propagation network or neural network controller. The control unit cuts the driving signal into n sections to generate a cutting information, and the cutting information is transmitted to the switching strategy demodulation unit.

In the switching driving method of the present invention, the switching strategy demodulation unit demodulates the switching duty cycle for each wave band of the driving waveforms, and arranges them into the switching signal by random operation way and stores them in the memory unit. The switching strategy demodulation unit is composed by one of the neural network controller, transmittal network controller, proportional controller, fuzzy controller, or random controller.

In the switching driving method of the present invention, the driving system further comprises: Execute the initialization setup, in order to set up any type of driving waveforms, or receive any type of waveforms information set up at outside. Execute the transformation procedure, in order to transform the driving waveforms into the switching signal. Upon executing the transformation procedure, the memory unit reads the driving waveforms, the control unit conducts the transformation procedure of the switching signal, and writes the result into the memory unit.

Comparing to the prior art, in the switching driving method of the present invention, the driving system transforms any type of driving waveforms to switching signal array by switching strategy modulation, and transmits to switching circuit. Any type of driving waveforms can be generated through high-speed switching the switching circuit.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DESCRIPTION OF THE PREFERRED EMBODIMENT

The Figures and the flow diagrams in the embodiment of the present invention are simplified illustrations. The Figures only show the devices and method related to the present invention. The devices and method are not the state at actual implementation. The method and number of devices, shape and ratio are alternative design at actual implementation, and the disposition type of devices may be more complicated.

Figure 1:
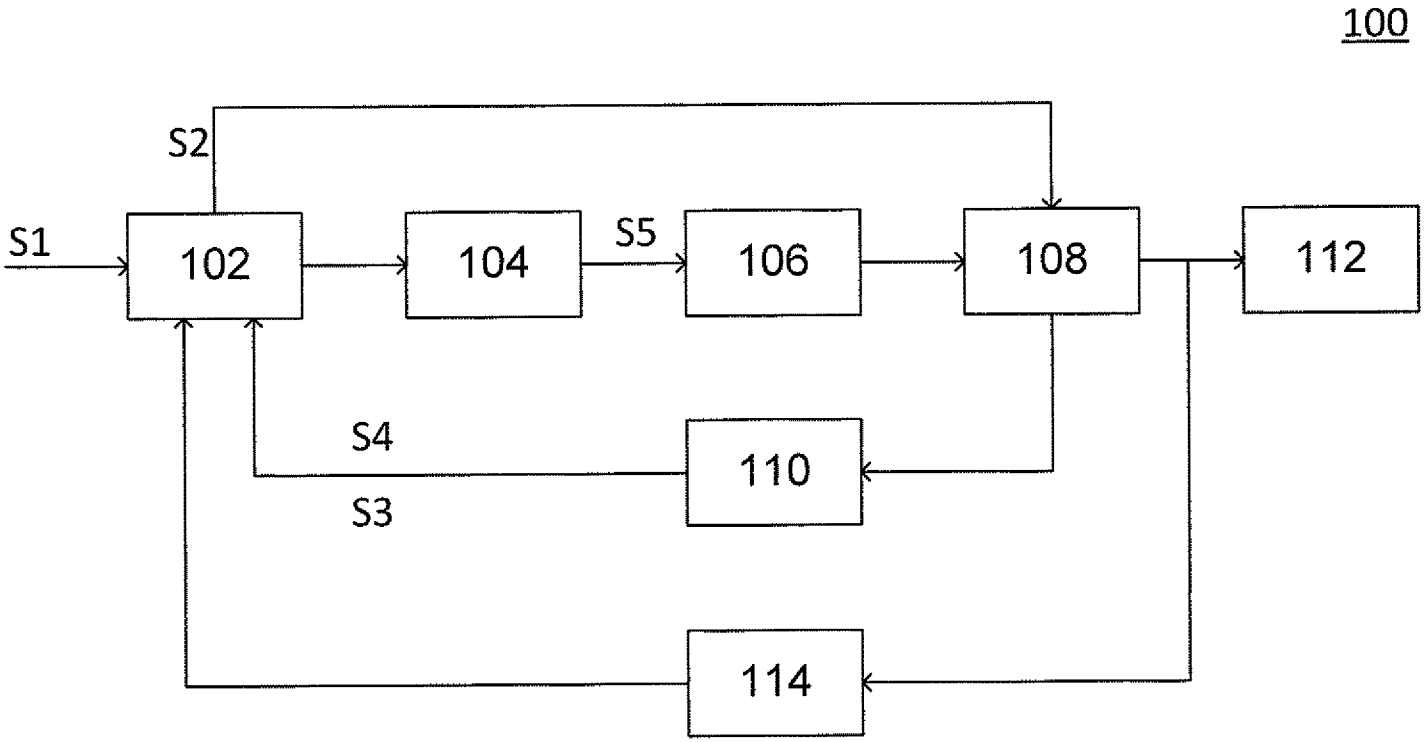
FIG. 1 shows a driving system in accordance of a preferred embodiment of the invention.

Please refer to FIG. 1, which shows a driving system in accordance of a preferred embodiment of the invention. Meantime, please refer to FIG. 2, which shows a switching driving method in accordance of a preferred embodiment of the invention.

As shown in FIG. 1, the driving system 100 of inkjet device comprises a control unit 102, a switching strategy demodulation unit 104, a memory unit 106, a shifting unit 108, a counting unit 110, a driving unit 112 and a sensing unit 114. Wherein, the control unit 102 is connected to the memory unit 106. The switching strategy demodulation unit 104 is connected between the control unit 102 and the memory unit 106. The memory unit 106 is connected to the shifting unit 108. The shifting unit 108 is connected to the control unit 102 and the memory unit 106.

As shown in FIG. 1, the user transmits the setup information of the driving waveforms to the control unit 102 through a user interface (not shown in Figure). The control unit 102 receives the driving signal S1, wherein the driving signal S1 possesses the driving waveforms, as shown in FIG. 3.

Figure 3:
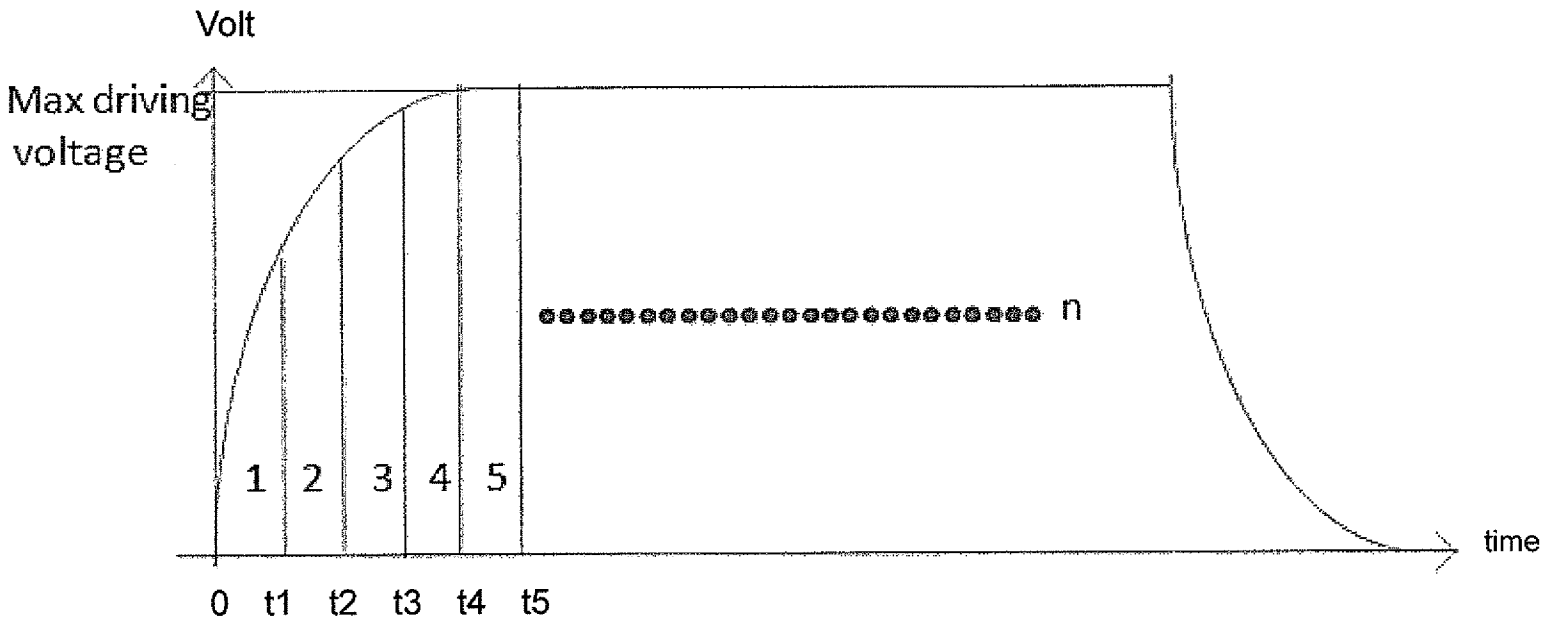
FIG. 3 shows the driving waveforms after setting by the user in a preferred embodiment of the invention.

FIG. 3 shows the driving waveforms after setting by the user in a preferred embodiment of the invention, which shows that a driving waveforms is cut into t1~tn sections. The switching strategy demodulation unit 104 transforms the driving waveforms to a switching state (that is the switching signal S5). The memory unit 106 remembers the switching state upgrade signal S4 transmitted by the control unit 102, and upgrades the switching state in accordance with the counting unit 110.

As shown in FIG. 1, the shifting unit 108 receives the content of memory unit 106, and conducts the shifting motion of length (n bit) in accordance with the length (n bit) of memory unit 106.

As shown in FIG. 1, the counting unit 110 checks the shifting times of shifting unit 108 in accordance with the length (n bit) of memory unit 106. When the shifting unit 108 makes n shifting times, the counting unit 108 transmits the switching state upgrade signal S4 to the control unit 102.

Figure 2:
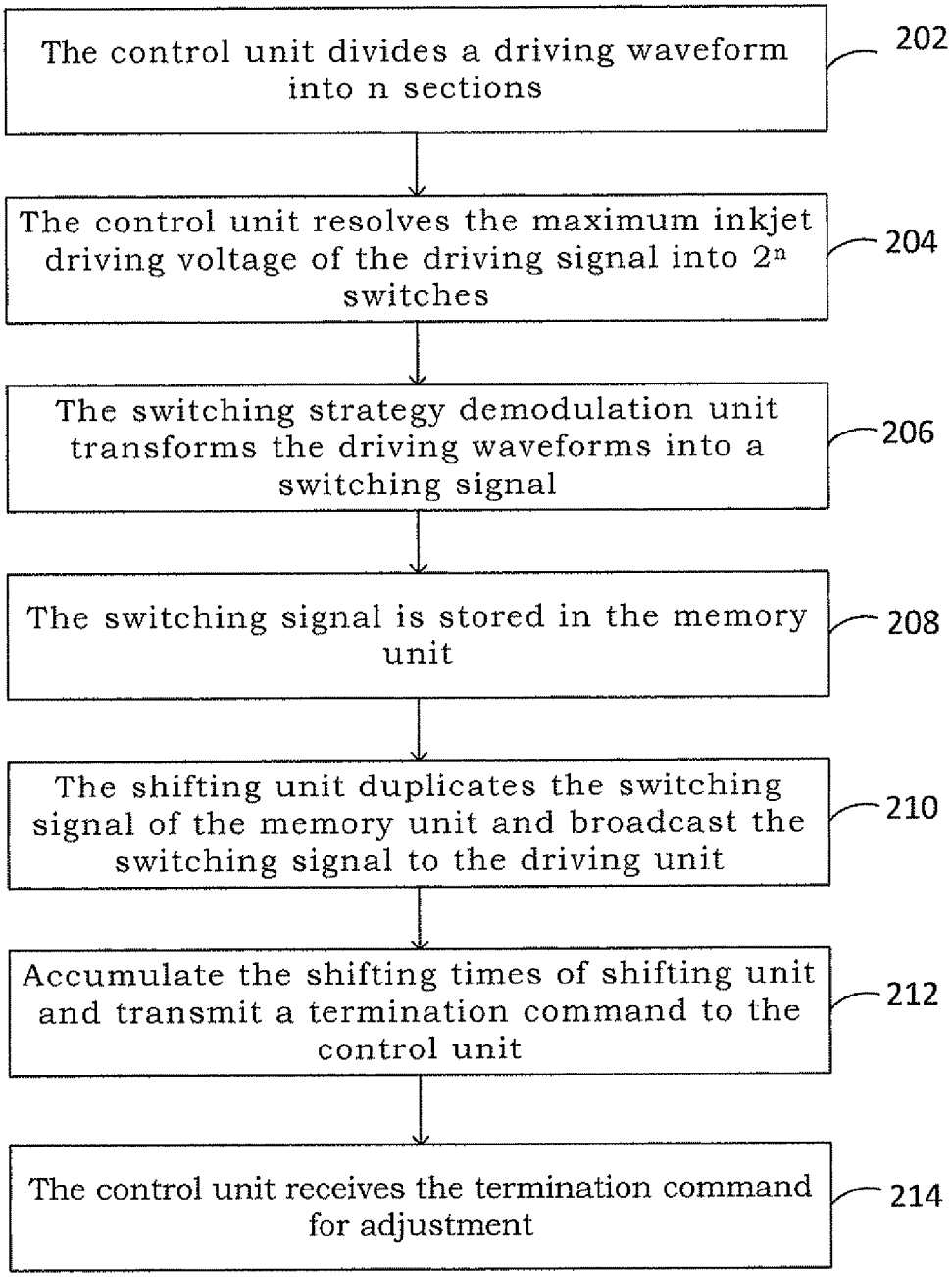
FIG. 2 a switching driving method in accordance of a preferred embodiment of the invention.

Please refer to FIG. 2. In Step 202, the control unit 102 divides a driving waveform into n sections (including 1~n sections). The control unit 102 transmits a state broadcast command S2 to the shifting unit 108. The control unit 102 receives the termination command S3 of the counting unit 110.

As shown in FIG. 1, the control unit 102 receives the switching state upgrade signal S4, transmits the switching state upgrade signal S4 to the memory unit 106, and upgrades the switching signal S5 in accordance with the counting unit 110. As shown in FIG. 1 of the present invention, the control unit 102 comprises one of the fuzzy controller, proportional, derivative, integral controller, back-propagation network, or neural network controller.

As shown in Step 204 of FIG. 2, the control unit 102 resolves the maximum inkjet driving voltage of the driving signal S1 into $2^n$ switches, in order to switch $2^n$ times within a pre-described time period t1. Please refer to FIG. 4, which shows the switching signal in accordance with a pre-described time period of FIG. 3. In addition, the control unit 102 cuts the driving signal into n sections to generate a cutting information, and the cutting information is transmitted to the switching strategy demodulation unit 104.

Figure 4:
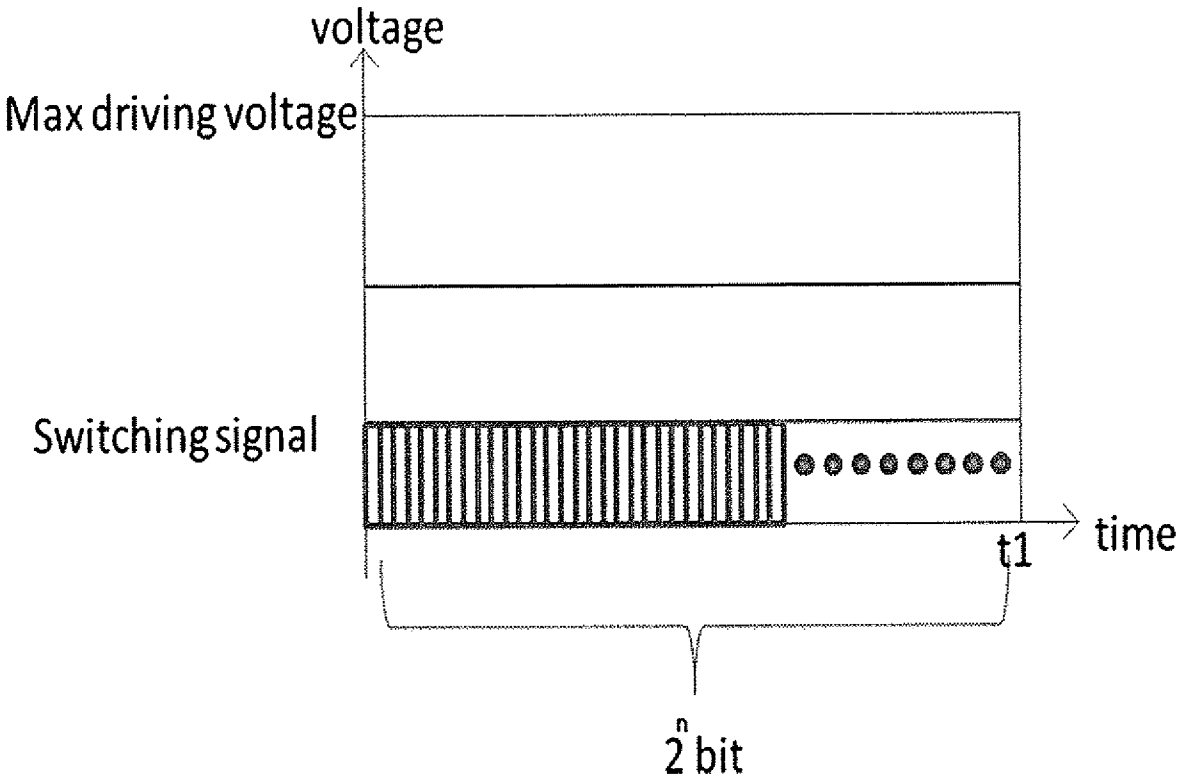
FIG. 4, which shows the switching signal in accordance with a pre-described time period of FIG. 3.

As shown in Step 206 of FIG. 2, the switching strategy demodulation unit 104 transforms the driving waveforms into a switching signal in accordance with the driving voltage of the driving signal S1. As shown in FIG. 4, the switching signals form a switching signal array.

Figure 5:
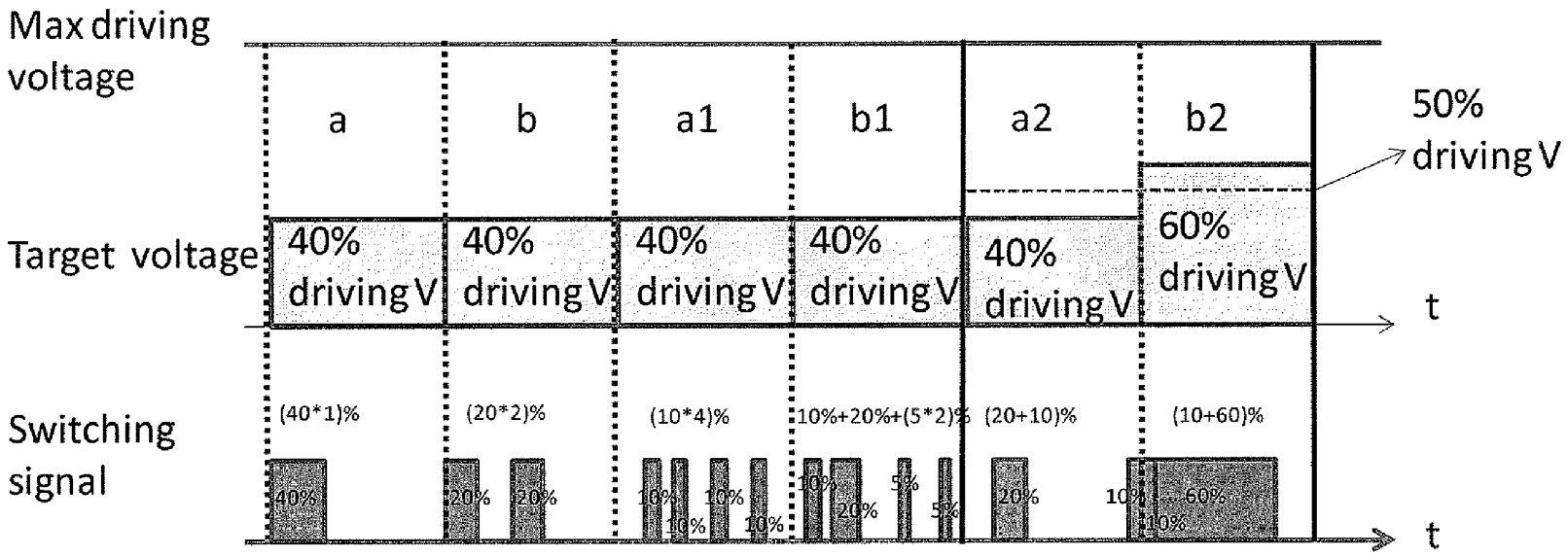
FIG. 5 shows a voltage-time diagram in accordance of a preferred embodiment of the invention.

Please refer to FIG. 5, which shows a voltage-time diagram in accordance of a preferred embodiment of the invention. The switching strategy demodulation unit 104 demodulates the switching duty cycle for each wave band of the driving waveforms, and arranges them into the switching signal S5 by random operation way and stores them in the memory unit 106. It has to describe that the switching strategy demodulation unit 104 is composed by one of the neural network controller, transmittal network controller, proportional controller, fuzzy controller, or random controller.

As for a, b, a1, b1, a2, b2 sections shown in FIG. 5, the maximum driving voltage can be obtained at 100% of switching duty cycle. When the driving voltage wants to output 40% of driving voltage, the switching control can be conducted through the switching strategy of a, b, a1, b1 etc. Due to the switching duty cycle of a, b, a1, b1 and so on is 40%, the average output voltage will be 40% of driving voltage. Except 40% of driving voltage can be switched from the above-mentioned four combinations, there are $2^n-1$ combinations. In limited combinations of switching strategy, the switching state can be obtained by random combination.

The duty cycle of switching signal at a2 section shown in FIG. 5 is 20%+10%. The average output voltage is 30% of driving voltage at a2, which is not equivalent to the target voltage in 40% of driving voltage. The time switching signal is 10%+60%, which is not equivalent to 70% of driving voltage required by target voltage. The average voltage of a2 and b2 is (0.4*driving voltage+0.6*driving voltage)/2=0.5*driving voltage. The switching duty cycle of a2 and b2 is ((30+70)%)/2=50%. Thus, 50% of driving voltage can be provided. After the switching duty cycle of wave band is known, the switching state can be obtained through random combination.

As shown in Step 208 of FIG. 2, the switching signal S5 is stored in the memory unit 106. It has to describe that the switching signal S5 of the present invention is the switching state. In this embodiment, the memory unit 106 is used to store the driving waveforms, the switching signal, read the waveforms state, and read the switching signal.

As shown in Step 210 of FIG. 2, the shifting unit 108 duplicates the switching signal S5 (that is the switching state) of the memory unit 106, and starts to broadcast the switching signal S5 to the driving unit 112.

As shown in Step 212 of FIG. 2, when the shift times of shifting unit 108 is accumulated to $2^n$ times by the counting unit 110, the counting unit 110 transmits a termination command S3 to the control unit 102. It has to describe that when the shift times of shifting unit 11O is reached $2^n$ times, a time of inkjet print head driving waveforms is generated by the driving system 100.

As shown in Step 214 of FIG. 2, after the control unit 102 receives the state termination command S3, it will be adjusted in accordance with the state of inkjet print quality or the demand of user.

Please refer to FIG. 3, the shifting unit 108 receives the content of memory unit 106, and conducts the shifting motion of length in accordance with the length (n bit) of memory unit 106. The counting unit 110 checks the shifting times of shifting unit 108 in accordance with the length (n bit) of memory unit 106. When the shifting unit 108 makes a specific number of shifting times, the counting unit 108 transmits the switching state upgrade signal S4 to the control unit 102.

As shown in FIG. 1, the switching driving method of the present invention further comprises executing the initialization setup, in order to set up any type of driving waveforms, or receive any type of waveforms information set up at outside. Execute the transformation procedure, in order to transform the driving waveforms into the switching signal S5. Upon executing the transformation procedure, the memory unit 106 reads the driving waveforms, the control unit 102 conducts the transformation procedure of the switching signal S5, and writes the result into the memory unit 106. The total harmonic distortion, signal noise ratio, frequency response, and spectrum parameter of the driving signal are fed back and corrected for improving the driving waveforms. The switching state is changed in accordance with a parameter of a sensing unit. The switching state is changed in accordance with the total harmonic distortion of the driving waveforms. The switching state is changed in accordance with the driving state of a loading unit. The switching state is changed in accordance with a parameter of a sensing unit.

As shown in FIG. 1, it has to describe that the minimum voltage value of the driving signal S1 determines the switching times of the switching signal S5 within minimum charging, discharging time. In addition, the charging effect or discharging effect of minimum voltage value is composed by a limited resolution within minimum charging time.

As shown in FIG. 1, the sensing unit 114 of this embodiment comprises the charge coupling device, the digital/analog converter, or the digital signal processing device.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A switching driving method used for a driving system, the driving system comprises a control unit, a switching strategy demodulation unit, a memory unit, a shifting unit and a counting unit, wherein the control unit being connected to the memory unit, the switching strategy demodulation unit being connected between the control unit and the memory unit, the memory unit being connected to the shifting unit, the shifting unit being connected to the control unit and the memory unit, the steps of switching driving method, comprising:

the control unit means for receiving a driving signal having a driving waveform, and cutting the driving signal into n sections;

the control unit means for resolving a driving voltage of the driving signal into $2^n$ switches in order to switch $2^n$ times within a pre-described time period;

the switching strategy demodulation unit means for transforming the driving waveform into the switching signal in accordance with the driving voltage of the driving signal, and the switching signals forming a switching signal array;

storing the switching signal in the memory unit;

the shifting unit means for duplicating the switching signal of the memory unit, beginning to broadcast the switching signal to a driving unit;

when the shift times of shifting unit being accumulated to $2^n$ times, the counting unit transmitting a termination command to the control unit; and after receiving the termination command, the control unit carries out on adjustment in accordance with a demand.

2. The method according to claim 1, wherein when the shift times of shifting unit is reached to $2^n$ times, a time of inkjet print head driving waveform is generated by the driving system.

3. The method according to claim 1, wherein the shifting unit receives the content of memory unit, and conducts the shifting motion of length in accordance with the length of memory unit, the counting unit checks the shifting times of shifting unit in accordance with the length of memory unit, when the shifting unit makes a specific number of shifting times, the counting unit transmits the switching state upgrade signal to the control unit.

4. The method according to claim 1, wherein the control unit is selected from the group consisting of fuzzy, proportional, derivative, integral, back-propagation network or neural network controller.

5. The method according to claim 1, wherein the control unit cuts the driving signal into n sections to generate a cutting information, and the cutting information is transmitted to the switching strategy demodulation unit.

6. The method according to claim 1, wherein the memory unit 106 is used to store the driving waveforms, the switching signal, read the waveforms state, and read the switching signal.

7. The method according to claim 1, wherein the control unit divides a driving waveform into a plurality of sections, and transmits a state broadcast command to the shifting unit, and the control unit receives a termination command and a switching state upgrade signal from the counting unit.

8. The method according to claim 7, wherein the memory unit remembers the switching state upgrade signal transmitted by the control unit, and upgrades the switching signal in accordance with the counting unit.

9. The method according to claim 1, wherein the switching strategy demodulation unit demodulates the switching duty cycle for each wave band of the driving waveforms, and arranges into the switching signal by random operation way and stores in the memory unit.

10. The method according to claim 9, wherein the switching strategy demodulation unit is composed by one of the neural network controller, transmittal network controller, proportional controller, fuzzy controller, or random controller.

11. The method according to claim 1, further comprising:

executing the initialization setup in order to set up any type of driving waveforms, or receive any type of waveforms information set up at outside;

executing the transformation procedure in order to transform the driving waveforms into the switching signal, upon executing the transformation procedure, the memory unit reads the driving waveforms, the control unit conducts the transformation procedure of the switching signal, and writes the result into the memory unit.

12. The method according to claim 11, further comprises the total harmonic distortion, signal noise ratio, frequency response, and spectrum parameter of the driving signal are fed back and corrected for improving the driving waveforms.

13. The method according to claim 11, further comprises the switching state is changed in accordance with a parameter of a sensing unit.

14. The method according to claim 11, further comprises the switching state is changed in accordance with the total harmonic distortion of the driving waveforms.

15. The method according to claim 11, further comprises the switching state is changed in accordance with the driving state of a loading unit.

16. The method according to claim 11, wherein the minimum voltage value of the driving signal determines the switching times of the switching signal within minimum charging, discharging time.

17. The method according to claim 16, wherein the charging effect of minimum voltage value is composed by a limited resolution within minimum charging time.

18. The method according to claim 16, wherein the discharging effect of minimum voltage value is composed by a limited resolution within minimum charging time.

19. The method according to claim 11, further comprises the switching state is changed in accordance with a parameter of a sensing unit.

20. The method according to claim 19, wherein the sensing unit comprises the charge coupling device, the digital/analog converter, or the digital signal processing device.

* * * * *